US007867110B2

(12) United States Patent
Edel

(10) Patent No.: US 7,867,110 B2
(45) Date of Patent: Jan. 11, 2011

(54) PUTTER FITTING METHOD

(76) Inventor: David Edel, 45171 State Hwy. 38, Reedsport, OR (US) 97467

( * ) Notice: Subject to any disclaimer, the term of this patent is extended or adjusted under 35 U.S.C. 154(b) by 29 days.

(21) Appl. No.: 12/258,005

(22) Filed: Oct. 24, 2008

(65) Prior Publication Data

US 2009/0270195 A1 Oct. 29, 2009

Related U.S. Application Data

(60) Provisional application No. 60/982,312, filed on Oct. 24, 2007.

(51) Int. Cl.
*A63B 69/36* (2006.01)

(52) U.S. Cl. ..... 473/409; 473/240; 473/407

(58) Field of Classification Search ..... 473/218, 473/219, 220, 238, 240, 243, 251, 266, 267, 473/268, 270, 272, 409, 407
See application file for complete search history.

(56) References Cited

U.S. PATENT DOCUMENTS 4,059,270 A 11/1977 Sayers
4,341,384 A * 7/1982 Thackrey ..... 473/222
5,452,897 A * 9/1995 Mick ..... 473/409
5,591,091 A 1/1997 Hackman
5,692,966 A * 12/1997 Wash ..... 473/221
5,993,333 A * 11/1999 Heckaman ..... 473/409
6,083,123 A 7/2000 Wood
6,224,493 B1 5/2001 Lee et al.
6,482,099 B1 * 11/2002 Schaum ..... 473/220
6,752,723 B2 6/2004 Cullen
6,793,585 B1 9/2004 Miyamoto et al.
6,966,843 B2 11/2005 Rankin et al.
2002/0091014 A1 7/2002 Aldrich
2004/0204257 A1 10/2004 Boscha et al.
2006/0030430 A1 2/2006 Rankin
2006/0166757 A1 7/2006 Butler et al.
2007/0049393 A1 3/2007 Gobush
2008/0200274 A1 * 8/2008 Haag et al. ..... 473/222

* cited by examiner

*Primary Examiner*—Nini Legesse
(74) *Attorney, Agent, or Firm*—Gonzales Patent Services; Ellen M. Gonzales

(57) ABSTRACT

A putter fitting method and system comprising a laser configured to deflect a laser beam off of a putter at address and strike a scoring map in such a way so as to indicate the any error's in a golfer's aim. The method and system may further comprise determining physical alterations to the golfer's putter in order to correct the aim errors. Such changes may be to the hosels (neck), hosel offset, hosel types, head shape, loft, line combination, length or the like. These changes may be suggested automatically, for example, by a computer program, based on the location of the laser strike, or by a fitting professional.

18 Claims, 1 Drawing Sheet

PUTTER FITTING METHOD

CROSS-REFERENCE TO RELATED APPLICATIONS

The following application claims benefit of U.S. Provisional Application No. 60/982,312, filed Oct. 24, 2007, which is hereby incorporated by reference in its entirety.

BACKGROUND

Putting is a very complicated and misunderstood part of the game of golf. Many factors go into becoming a proficient putter. Much of the confusion connected to putting derives from poor aim. Though, golfers do not intentionally aim incorrectly, an average of 97% (based on valid studies) of the current golfing population aims incorrectly. Accordingly, individualized putters and putter-fitting systems that account for an individual golfer's particular aiming quirks or foibles would be of great benefit.

SUMMARY OF THE INVENTION

A putter fitting method and system comprising a laser configured to deflect a laser beam off of a putter at address and strike a scoring map in such a way so as to indicate the any error's in a golfer's aim. The method and system may further comprise determining physical alterations to the golfer's putter in order to correct the aim errors. Such changes may be to the hosel (neck), hosel offset, hosel type, head shape, loft, line combination, length or the like. These changes may be suggested automatically, for example, by a computer program, based on the location of the laser strike, or by a human fitting professional.

DETAILED DESCRIPTION

Figure 1:
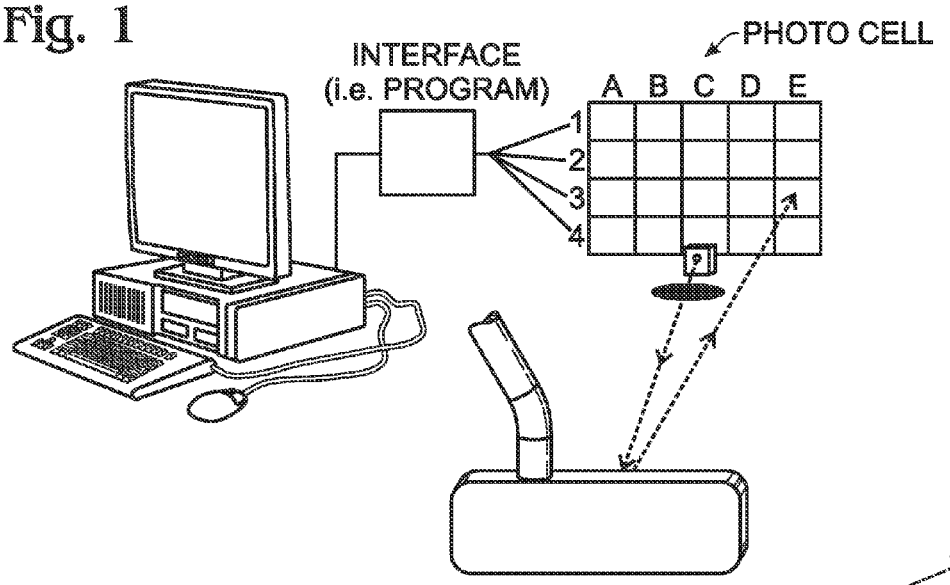
FIG. 1 is a schematic diagram of a putter fitting system according to an embodiment of the present disclosure.
Figure 2:
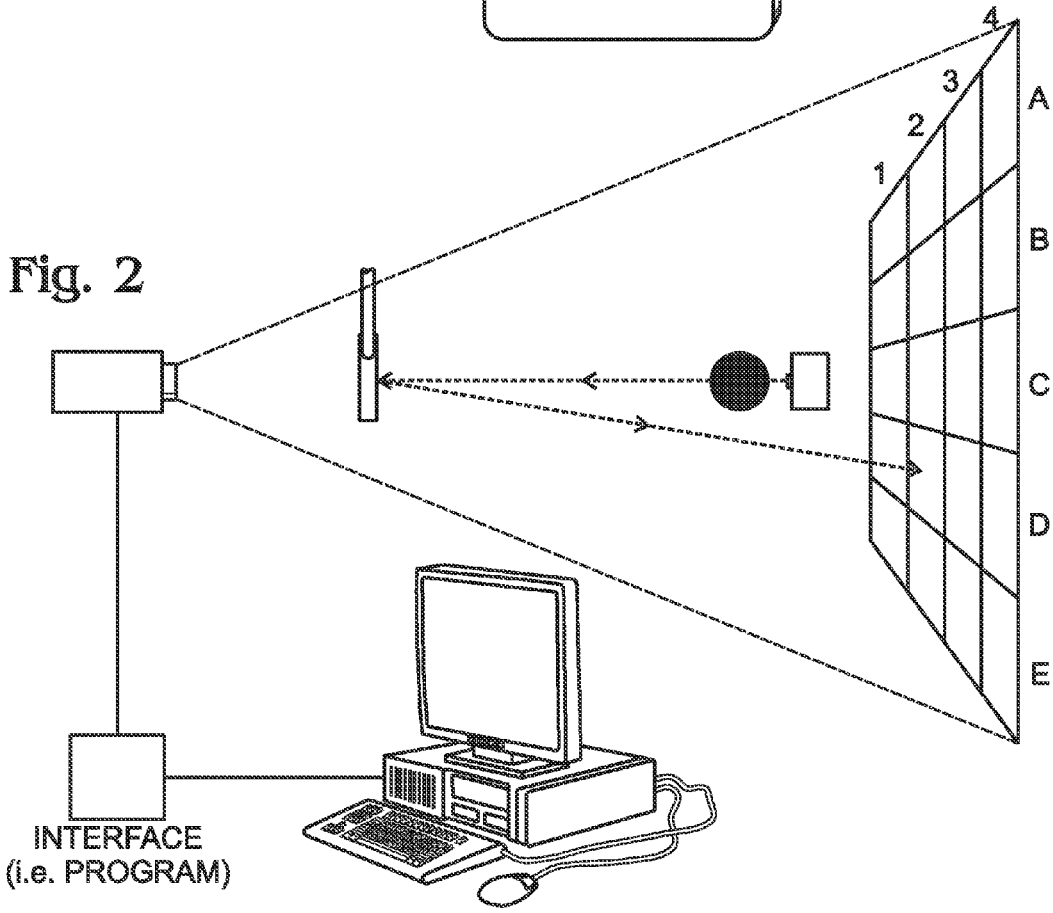
FIG. 2 is a schematic diagram of a putter fitting system according to an embodiment of the present disclosure

According to one embodiment, the present disclosure provides a putter fitting system that corrects for inaccurate aim by providing a fitting system that allows putters to be custom-fit to an individual golfer's particular needs. For the purposes of the present disclosure, the term "golfer" is used to refer to the person who is aiming the putter. The term "fitting professional" is used to refer to a person or entity (artificial or real) that provides suggestions to the golfer. In some cases the golfer and fitting professional may be the same person. Furthermore, the term "fitting professional" is not intended to require any type of professional knowledge, certification, or degree. Unless stated otherwise, the term "putter" is used to refer to a specific type of golf club that is used to putt the ball.

In one embodiment, the system described herein evaluates a golfer's putting aim (or aim and stroke, as described below) and provides suggested changes to individual variables in the putter so as to enable the golfer to optimize his or her putting ability. Putter variables include, but are not limited to, the alteration, replacement, or other modification to: hosels (necks), hosel offsets, hosel types, head shapes, lofts, line combinations (i.e., aiming guides or marks that can be drawn, machined, or otherwise provided on the top of the putter to help the golfer line up his or her shot), shaft lengths, grip sizes, grip types, and the like. Typically, these variables elicit a specific aiming response in an individual golfer. Changing one or more of these variables will typically produce an altered aiming response in the golfer.

According to one embodiment the evaluation process includes providing a system having a putter with a reflective surface on its face, a laser configured to direct a laser beam towards the face of the putter, and a scoring map on to which the laser beam is directed after being reflected by the putter face. The laser may be situated within a target that is intended to simulate, for the golfer, the cup into which the golf ball is to be putted. In this embodiment, a golfer who wishes to have his or her aim evaluated so that appropriate physical changes can be made to his or her putter (or to help him or her purchase a putter that is best suited for his or her particular aiming quirks), addresses a ball placed a given distance away from the laser as he or she normally would to putt the ball into the cup. It shall be understood that the "golf ball" that the golfer addresses with his or her putter need not be an actual golf ball, but could, instead be a representation of a golf ball, or some other object that provides a sufficient visual representation so as to allow the golfer to address the "golf ball" with his or her normal stance and (his or her believed) proper alignment. In some cases the target may be a cup-sized objective, a simulation thereof, or any other suitable target. Exemplary distances between the golf ball and the laser may be those distance at which one would normally putt the ball, e.g., between 0-3 ft, 0-6 ft, 0-12 ft, 0-36 ft, 3-18 ft, or any other suitable or desirable distance. The golfer aligns his or her putter behind the golf ball in the alignment that he or she believes is the alignment that, upon stroking the ball, would result in putting the ball at or into the target. As stated above, the putter face contains a mirror or otherwise suitably reflective surface situated thereon such that, after the golfer perceives that he or she is correctly aimed, the golf ball can be removed, and the laser beam is able to rebound or deflect off of the reflective surface on the putter face and strike the scoring map, thereby indicating the true aim of the player. Aim contains both lateral (putter face angle) and vertical (effective loft) elements. The particular position where the laser hits the mirror indicates to the fitting professional the necessary change in one or more physical variables of the putter to correct the aim response. The golfer can then be provided with a putter that includes one or more modifications suggested by the fitting professional as a result of the laser-assisted putter alignment test. This process is executed until the putter's variations correspond to the golfer's ability to correctly aim the putter towards the identified aiming point.

The scoring map may take the form of a mobile or immobile backdrop, wall, vertical surface, electronic monitor, computer screen, or the like. For the purposes of the present disclosure, the scoring map may also be referred to herein as a backdrop or panel. The scoring map may or may not have markings on it to help identify the golfer's aiming issues and/or provide suggestions regarding putter modifications. Accordingly, the present disclosure provides a process that allows for the evaluation of the laser aim response during a fitting session. This laser aim response is accurate and definable.

According to one embodiment, the scoring map is physically divided into small quadrants, which may or may not be visible to the golfer or the fitting professional. When the laser strikes the scoring map, it hits a physical location on the scoring map which is associated with one or more of these quadrants. Each quadrant may be assigned a code. The panel may be of any suitable size. For example, a 36"×28" size panel has been found to be useful an embodiment of the presently disclosed invention. Suitable detection methods for evaluating which quadrant has been hit include photo cells within the backdrop or a camera system, for example placed directly behind the backdrop. Each quadrant may then be indicative of or associated with a particular aiming disparity, which can then be corrected by one or more physical changes to the golfer's putter.

In some embodiments, the putter fitting system includes a program that identifies the hit response and makes a recommendation for a change to the putter, for example, by recommending a different hosel, loft angle, aiming line, or combination thereof. The recommendation may be automatically generated by the program, or the program may simply alert the golfer or fitting professional that a change is indicated. If the program simply provides an alert, the fitting professional may then suggest alterations to the club based on some or all of the data generated by the fitting system. In an automated system (one in which the program makes suggestions), the program may be provided with putter-fitting rules. In some embodiments, these putter fitting rules may be provided by one or more fitting professionals based on real data, data modeling, past experience, general knowledge, belief, or the like. The program may also incorporate a learning program, which enables it to generate its own rules over time, based on cumulated data. Accordingly, the program may be designed to gain speed and accuracy over time to become smarter and more proficient.

It should be understood that this putter fitting system is not limited to one particular company's products, but could encompass variables from other company products and variations. In some embodiments, it may be preferably for the system to use an interchangeable component system. Such a component system could have calibrated variables that are quantifiable and known by the program, thereby increasing the likelihood of generating accurate suggestions to improve the golfer's aim response. In some embodiments, each variable in the system may have an identifying code so the fitting professional can accurately change the variables, i.e., putter head #1, loft plate 3 deg, hosel=L2 2 deg flat, line combination=one line middle bottom, length=34 inches.

After identifying a first aim response and providing a first putter recommendation, the system could be designed to repeat the process until the desired aim is achieved.

According to yet another embodiment, the backdrop evaluation system could be directly linked to a motion based system to evaluate the dynamic motion of the putter with its corresponding aim response. The program could evaluate the aim and motion of the putter and recommend physical changes in the variables necessary for better dynamic movement.

It is noted that according to some embodiments, the present system reviews the golfer's aim without requiring the golfer to hit the ball. Accordingly, unlike any method of putter fitting that evaluates ball flight (or roll), some embodiments of the presently described putter fitting method are independent of and do not rely on the golfer's ability to read the green, but instead, look only at the golfer's ability to aim at the desired target. Furthermore, the system described herein is rather inexpensive to build and set up and can be transported easily.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications. The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. The methods and processes illustratively described herein suitably may be practiced in differing orders of steps, and that they are not necessarily restricted to the orders of steps indicated herein or in the claims. As used herein and in the appended claims, the singular forms "a," "an," and "the" include plural reference unless the context clearly dictates otherwise. Thus, for example, a reference to "a host cell" includes a plurality (for example, a culture or population) of such host cells, and so forth.

Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein. In addition, where features or aspects of the invention are described in terms of Markush groups, those skilled in the art will recognize that the invention is also thereby described in terms of any individual member or subgroup of members of the Markush group.

What is claimed is:

1. A putter fitting method comprising:

allowing a golfer to address a golf ball with a putter and aim at a target;

focusing a laser beam such that the beam deflects off of a reflective surface on the face of the putter and hits an area on a scoring map, wherein the area on the scoring map that is struck by the laser beam provides an indication of the golfer's aim when addressing the golf ball;

a computer program configured to receive data identifying the area on the scoring map that is struck by the laser beam and suggest physical changes to the putter.

2. The method of claim 1 wherein the area on the scoring map that is hit by the laser beam provides an indication of physical alterations to be made to the putter so as to allow the golfer to achieve a more favorable aim towards the target.

3. The method of claim 1 wherein the physical change suggested by the computer program is a specific aim line combination.

4. The method of claim 3 further comprising:

allowing the golfer to address a golf ball with the geometrically altered putter and aim at the target;

focusing a laser beam such that the beam deflects off of a reflective surface on the face of the geometrically altered putter and hits an area on the scoring map; and determining if the putter's aim is more accurate with the geometrically altered putter.

5. The method of claim 1 wherein the physical change suggested by the computer is a change to the physical geometry of the putter.

6. The method of claim 1 further comprising physically altering a geometric component of the putter.

7. The method of claim 6 wherein the geometric component is the head shape.

8. The method of claim 6 wherein the geometric component is the loft plate angle.

9. The method of claim 6 wherein the geometric component is the hosel.

10. The method of claim 9 wherein the geometric component is the hosel offset.

11. A putter fitting system comprising:

a putter having a reflective surface on the putter face, the reflective surface being sufficient to deflect a laser beam;

a laser configured to direct a laser beam at the reflective surface; and a scoring map; wherein the laser beam is deflected off of the putter face and onto the scoring map when a golfer address a target, and wherein the area on the scoring map that is struck by the deflected laser beam is indicative of the golfer's aim in addressing the target;

a computer program configured to identify the area on the scoring map that was struck and suggest physical changes to the golfer's putter in order to correct the golfer's aim.

12. The putter fitting system of claim 11 further comprising a computer program configured to identify the area on the scoring map that was struck and suggest geometric changes to the golfer's putter in order to correct the golfer's aim.

13. The method of claim 11 wherein the physical change suggested by the computer program is a specific aim line combination.

14. The method of claim 11 wherein the physical change suggested by the computer program is the alternation of a geometric component of the putter.

15. The putter fitting system of claim 11 wherein the geometric component is the head shape.

16. The putter fitting system of claim 11 wherein the geometric component is the loft plate angle.

17. The putter fitting system of claim 11 wherein the geometric component is the hosel.

18. The putter fitting system of claim 11 wherein the geometric component is the hosel offset.

* * * * *